US009127692B2

(12) United States Patent
Goenka

(10) Patent No.: US 9,127,692 B2
(45) Date of Patent: Sep. 8, 2015

(54) GUIDE DEVICE FOR A CENTRIFUGAL BLOWER

(75) Inventor: Lakhi Nandlal Goenka, Ann Arbor, MI (US)

(73) Assignee: Halla Visteon Climate Control Corporation, Daejeon-si (KR)

( * ) Notice: Subject to any disclaimer, the term of this patent is extended or adjusted under 35 U.S.C. 154(b) by 1065 days.

(21) Appl. No.: 12/983,962

(22) Filed: Jan. 4, 2011

(65) Prior Publication Data

US 2012/0171032 A1 Jul. 5, 2012

(51) Int. Cl.
*F04D 29/44* (2006.01)

(52) U.S. Cl.
CPC ..... *F04D 29/441* (2013.01)

(58) Field of Classification Search
CPC ..... F04D 29/44; F04D 29/441; F04D 29/444
USPC ..... 415/183, 185, 189, 190, 203, 204, 206, 415/208.1, 208.2, 224
See application file for complete search history.

(56) References Cited

U.S. PATENT DOCUMENTS

| | | | | | |
|---|---|---|---|---|---|
| 2,290,423 | A | * | 7/1942 | Funk | 415/151 |
| 3,221,983 | A | * | 12/1965 | Trickler et al. | 415/204 |
| 4,573,869 | A | * | 3/1986 | Kitamoto | 415/211.1 |
| 5,066,194 | A | | 11/1991 | Amr et al. | |
| 5,342,167 | A | | 8/1994 | Rosseau | |
| 5,478,201 | A | | 12/1995 | Amr | |
| 5,520,513 | A | | 5/1996 | Kuroki et al. | |
| 5,551,836 | A | * | 9/1996 | Roth et al. | 415/204 |
| 5,749,702 | A | | 5/1998 | Datta et al. | |
| 5,839,879 | A | | 11/1998 | Kameoka et al. | |
| 5,855,469 | A | | 1/1999 | McConnell | |
| 5,951,245 | A | * | 9/1999 | Sullivan | 415/192 |
| 6,299,409 | B1 | | 10/2001 | Matsunaga et al. | |
| 6,575,701 | B2 | | 6/2003 | Kamiya et al. | |
| 6,821,088 | B2 | | 11/2004 | Sakai et al. | |
| 7,108,482 | B2 | | 9/2006 | Chapman | |
| 7,351,031 | B2 | | 4/2008 | Horng et al. | |
| 7,478,993 | B2 | | 1/2009 | Hong et al. | |
| 2005/0074332 | A1 | * | 4/2005 | Adamski et al. | 415/211.1 |
| 2005/0163614 | A1 | | 7/2005 | Chapman | |
| 2008/0187439 | A1 | * | 8/2008 | Iyer | 415/204 |

FOREIGN PATENT DOCUMENTS

| | | | | |
|---|---|---|---|---|
| JP | 61028797 | A | * | 2/1986 |
| JP | 10141294 | A | * | 5/1998 |

* cited by examiner

*Primary Examiner* — Dwayne J White
*Assistant Examiner* — Ryan Ellis
(74) *Attorney, Agent, or Firm* — Fraser Clemens Martin & Miller LLC; James D. Miller

(57) ABSTRACT

A centrifugal blower including a hollow housing and an impeller having a plurality of blades disposed in the hollow housing, wherein the impeller causes a fluid received in a fluid inlet of the hollow housing to flow in a radially outward direction to a fluid outlet of the hollow housing. A guide device for directing the flow of the fluid in the blower is disposed in the fluid inlet of the hollow housing, the guide device including a shroud configured to militate against turbulence, noise, a recirculation of flow of the fluid at the fluid inlet, and interference between the guide device and balance weights of the blower during an assembly of the blower.

18 Claims, 4 Drawing Sheets

GUIDE DEVICE FOR A CENTRIFUGAL BLOWER

FIELD OF THE INVENTION

The present invention relates to a centrifugal blower and more particularly to a centrifugal blower including a guide device for directing a flow of a fluid therein.

BACKGROUND OF THE INVENTION

Centrifugal blowers known in the art typically include a housing having a compartment, an axial fluid inlet, and a radial fluid outlet. An impeller having a plurality of blades is disposed in the compartment of the housing. The blades are arranged around a rotational axis of the impeller and attached to a hub of the impeller for rotation therewith. Rotational movement of the impeller causes a flow of fluid received in the fluid inlet to flow in a radially outward direction in respect to the impeller to the fluid outlet. A shield may be provided in the fluid inlet to militate against inadvertent contact with the impeller and direct the flow of the fluid through the fluid inlet. The shield is typically stationary and a proximity of an edge of the shield to the rotating blades of the impeller can cause turbulence and noise.

In climate control applications such as heating, ventilating, and air conditioning (HVAC) systems of a vehicle, the centrifugal blowers are required to operate effectively and efficiently over a range of operating conditions. Different operating conditions of the system occur as a result of a desired mode and output of the system. Based on the desired mode and output, various vent doors within duct passages of the system are selectively opened and closed to direct the flow of fluid therethrough. Generally, each of the duct passages has a different flow resistance. The flow resistance, typically, is greatest in a floor mode, a heating mode and a defrost mode, and least in an air conditioning mode. In some instances, the flow resistance during the floor, the heating, and the defrost modes can cause an accumulation of pressure and fluid in the compartment.

It is desirable to produce a centrifugal blower including a shield that performs as a tunable guide device to minimize turbulence, noise, and a recirculation flow of the fluid at the fluid inlet of the housing.

SUMMARY OF THE INVENTION

In concordance and agreement with the present invention, a centrifugal blower including a shield that performs as a tunable guide device to minimize turbulence, noise, and a recirculation flow of the fluid at the fluid inlet of the housing, has surprisingly been discovered.

In one embodiment, the centrifugal blower comprises: a hollow housing having a fluid inlet and a fluid outlet formed therein; an impeller having a plurality of blades disposed in the hollow housing, wherein the impeller causes a fluid received in the fluid inlet to flow in a radially outward direction to the fluid outlet; and a guide device disposed in the fluid inlet, the guide device including a shroud having a leading edge and a trailing edge, wherein the shroud is configured to militate against a recirculation of flow of the fluid at the fluid inlet of the hollow housing.

In another embodiment, the centrifugal blower comprises: a hollow housing having a fluid inlet and a fluid outlet formed therein; an impeller having a plurality of blades disposed in the hollow housing, wherein the impeller causes a fluid received in the fluid inlet to flow in a radially outward direction to the fluid outlet; and a guide device disposed in the fluid inlet, the guide device including a central hub, an outer ring, a plurality of blades formed to extend between the central hub and the outer ring, and a shroud formed between a pair of the blades, the shroud configured to militate against a recirculation of flow of the fluid at the fluid inlet of the hollow housing, wherein the shroud includes a leading edge and a trailing edge.

In another embodiment, the centrifugal blower comprises: a hollow housing having a fluid inlet and a fluid outlet formed therein; an impeller having a plurality of blades disposed in the hollow housing, wherein the impeller causes a fluid received in the fluid inlet to flow in a radially outward direction to the fluid outlet; and a guide device disposed in the fluid inlet, the guide device including a shroud configured to militate against turbulence, noise, a recirculation of flow of the fluid at the fluid inlet of the hollow housing, and an interference between the guide device and balance weights of the blower during an assembly of the blower, wherein the shroud is positioned in the fluid inlet such that a trailing edge of the shroud and a cutoff position of the blower define a predetermined angle.

DESCRIPTION OF THE DRAWINGS

The above, as well as other advantages of the present invention, will become readily apparent to those skilled in the art from the following detailed description, when considered in the light of the accompanying drawings.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
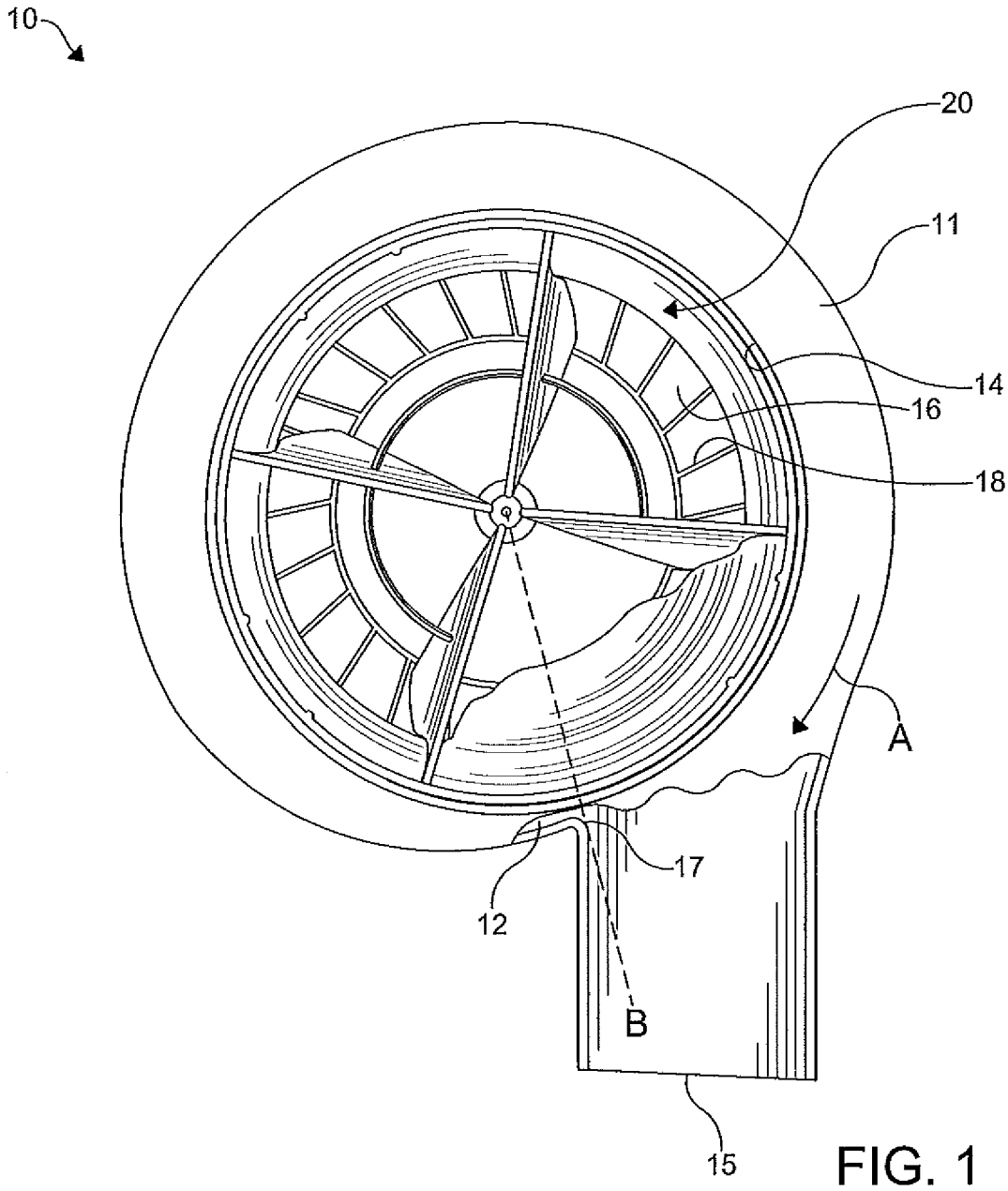
FIG. 1 is a fragmentary plan view partially in section of a centrifugal blower according to an embodiment of the invention.

FIG. 1 shows a centrifugal blower 10 in accordance with the present invention. The blower 10 includes a housing 11 having a compartment 12, an axial fluid inlet 14, and a tangential fluid outlet 15. In the embodiment shown, the fluid inlet 14 is a central opening formed in the housing 11. An impeller 16 having a plurality of blades 18 arranged around a rotational axis of the impeller 16 is disposed in the compartment 12 of the housing 11. The blades 18 are annularly spaced from one another and attached to a hub (not shown) of the impeller 16 for rotation therewith. The impeller 16 shown is driven by a motor (not shown). It is understood, however, that the impeller 16 can be caused to rotate by any manual or automatic means as desired. Rotational movement of the impeller 16 in a first direction causes a flow of fluid received in the fluid inlet 14 to flow in a radially outward direction in respect of the impeller 16, indicated by arrow A. The fluid flows at an increased pressure to the fluid outlet 15. In the embodiment shown, the fluid outlet 15 is formed in the housing 11 of the blower 10 and includes a cutoff edge 17. The cutoff edge 17 is positioned closer to the impeller 16 than any other part of the housing 11.

Figure 2:
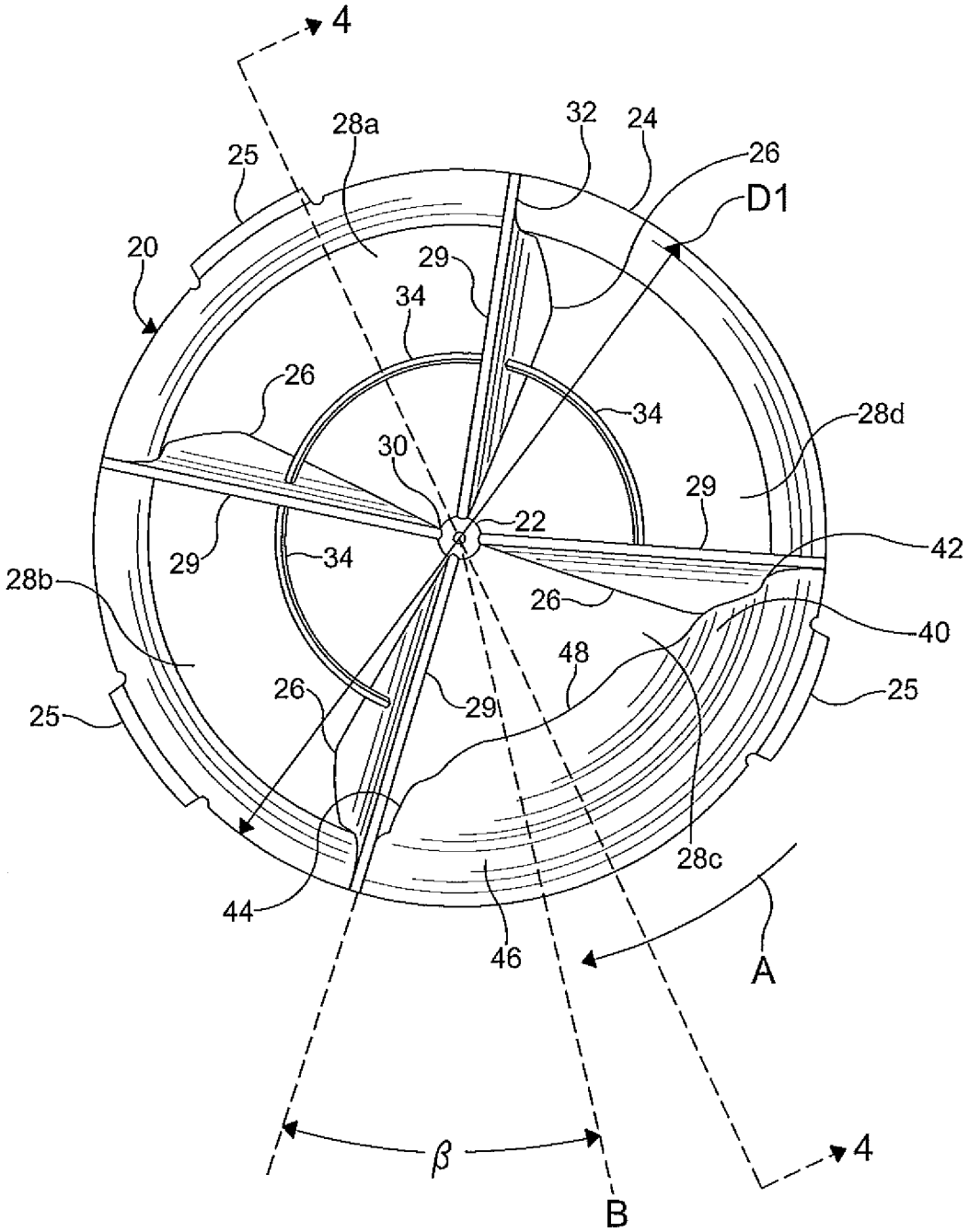
FIG. 2 is a plan view of a guide device for directing a flow of a fluid of the centrifugal blower illustrated in FIG. 1.
Figure 3:
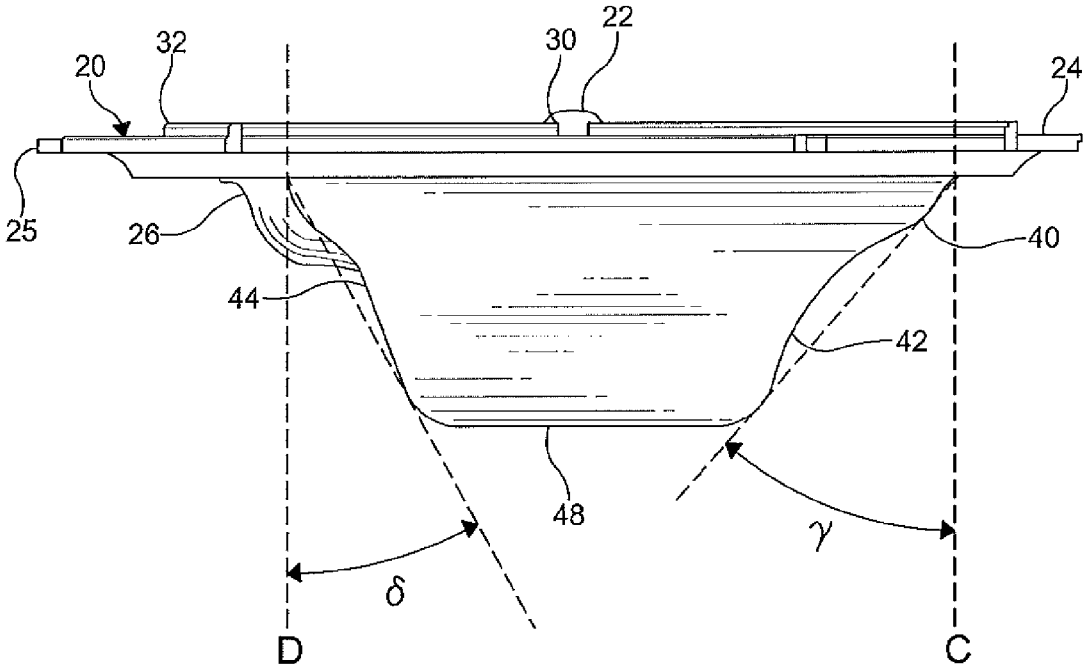
FIG. 3 is a side elevational view of the guide device illustrated in FIG. 2.
Figure 4:
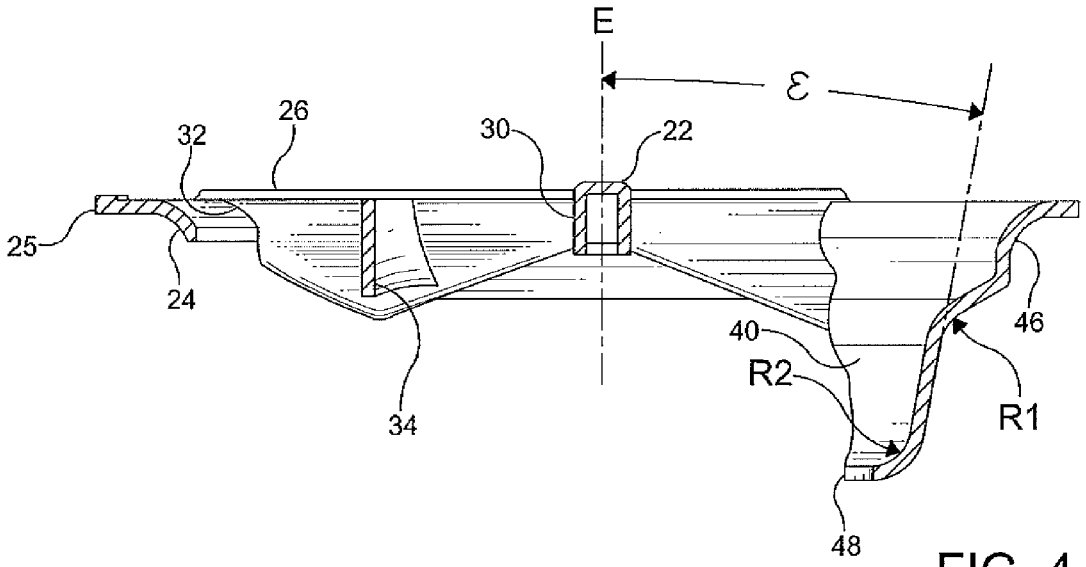
FIG. 4 is a cross-sectional view of the guide device illustrated in FIGS. 2 and 3 taken along section line 4-4.

A guide device 20 for directing the flow of fluid is disposed in the fluid inlet 14. It is understood that the guide device 20 can be formed from any suitable material as desired such as a plastic material, for example. It is further understood that the guide device 20 can be formed by any forming process as desired such as an injection molding process, for example. As illustrated in FIGS. 2-4, the guide device 20 includes a central hub 22 and an outer ring 24 having a plurality of positioning tabs 25 extending radially outwardly therefrom. The guide device 20 shown has a height in a range of about 40 mm to about 65 mm. In a non-limiting example, the guide device 20 has a height of about 41 mm. It is understood that the guide device 20 can have any height as desired. The outer ring 24 has a diameter of D1. In a non-limiting example, the diameter D1 is about 140 mm. It is understood, however, that the outer ring 24 can have any diameter as desired. A plurality of blades 26 extends between the central hub 22 and the outer ring 24. Additional or fewer blades 26 than shown can be employed if desired. As illustrated, the blades 26 are arranged in an annular array, defining open areas 28*a*, 28*b*, 28*c*, 28*d*. It is understood, however, that the blades 26 can be arranged in any configuration as desired.

Each of the blades 26 has a generally arcuate cross-sectional shape having a convex surface 29 curved outward into and substantially perpendicular to the direction of flow A of the fluid. It is understood that the blades 26 can have any cross-sectional shape as desired. A first end 30 of the blades 26 is affixed to the central hub 22 and a second end 32 is affixed to the outer ring 24. As shown in FIGS. 2 and 4, each of the blades 26 has a tapered width and a tapered height which gradually increases from the first end 30 of the blades 26 to the second end 32 thereof. A support member 34 is disposed between the blades 26 in the open areas 28*a*, 28*b*, 28*d*. It is understood that a support member 34 may be disposed in the open area 28*c* if desired.

The guide device 20 further includes a shroud 40. In the embodiment shown, the shroud 40 is integrally formed with the outer ring 24 and extends into the open area 28*c* to cover an inlet end of at least a portion of the blades 18 of the impeller 16. It is understood, however, that the shroud 40 can be integrally formed with adjacent blades 26 or separately formed with the outer ring 24, if desired. It is further understood that the shroud 40 can be formed to extend into any of the open areas 28*a*, 28*b*, 28*d*, if desired.

The shroud 40 includes a leading edge 42 and a trailing edge 44. Each of the leading edge 42 and the trailing edge 44 may be radiussed if desired. The shroud 40 is shaped to have substantially the same curvature in respect of the fluid inlet 14 as the outer ring 24 such that the edges 42, 44 are substantially perpendicular to the direction of flow A of the fluid. It is understood, however, that each of the leading edge 42 and the trailing edge 44 of the shroud 40 can be turned inward so that the edges 42, 44 are at an angle in respect to the direction of flow A of the fluid. In a non-limiting example, the leading edge 42 and the trailing edge 44 of the shroud 40 are turned inward toward a central axis E of the guide device 20, as indicated in FIG. 4, at an angle in a range of about 10° to about 20° relative to the direction of flow A of the fluid. It is understood that each of the edges 42, 44 can be turned inward toward the central axis at any angle relative to the direction of flow A of the fluid as desired. The inwardly turned edges 42, 44 of the shroud 40 militate against noise and turbulence produced by the flow of the fluid and a rotation of the blades 18 past the shroud 40.

As illustrated in FIGS. 1 and 2, the guide device 20 is positioned in the fluid inlet 14 so that the trailing edge 44 of the shroud 40 and a position B of the cutoff edge 17 relative to the central axis E of the guide device 20 define an angle β. In a non-limiting example, the angle β is in a range of about 15 degrees to about 30 degrees. It is understood that the angle β can be any angle as desired. The shroud 40 has a tapered width which gradually decreases from a portion 46 adjacent the outer ring 24 to a free edge 48 thereof. In a non-limiting example, a width of the shroud 40 at the portion 46 is in a range of about 60 mm to about 100 mm and gradually decreases to a width in a range of about 30 mm to about 60 mm at the edge 48. In another non-limiting example, the width of the shroud 40 at the portion 46 is about 85 mm and gradually decreases a width of about 49 mm at the edge 48. It is understood that the edge 48 may be radiussed if desired. The radiussed edges 42, 44, 48 of the shroud 40 further militate against noise and turbulence produced by the flow of the fluid and a rotation of the blades 18 past the shroud 40.

In the embodiment shown, the shroud 40 has a height from the portion 46 to the edge 48 in a range of about 35 mm to about 60 mm. It is understood that the shroud 40 can have any height as desired. The leading edge 42 and a plane C substantially parallel to the central axis E of the guide device 20 define an angle γ. In a non-limiting example, the angle γ is in a range of about 25° to about 45°. The trailing edge 44 and a plane D substantially parallel to the central axis E of the guide device 20 define an angle δ. In one non-limiting example, the angle δ is in a range of about 25° to about 45°. In another non-limiting example, the angle γ and the angle δ are substantially equal. In yet another non-limiting example, the angle γ is greater than the angle δ. It is understood, however, that the angles γ, δ can be any angles as desired.

In the embodiment shown in FIG. 4, the shroud 40 is slanted relative to the central axis E at an angle ϵ to militate against interference between the guide device 20 and balance weights of the blower 10 during an assembly of the blower 10. In a non-limiting example, the angle ϵ is about 10.8 degrees. It is understood that the angle ϵ can be any angle as desired. The shroud 40 may further include a radius R1 formed in an intermediate portion thereof to militate against interference between the guide device 20 and the blades 18 of the impeller 16. In a non-limiting example, the radius R1 is about 8 mm. A radius R2 may be formed in a portion of the shroud adjacent the edge 48 to further militate against interference between the guide device 20 and balance weights of the blower 10 during the assembly of the blower 10. In a non-limiting example, the radius R2 is about 6.3 mm. It is understood that the radii R1 and R2 can be any radius as desired. The guide device 20 is tunable to interfere with a tone produced by the rotation of the blades 18 of the impeller 16 past the cutoff edge 17. In particular, the guide device 20 is tuned by adjusting at least one of the angles β, γ, δ, ϵ or at least one of the radii R1, R2. Interference with the tone produced by the rotation of the blades 18 of the impeller 16 past the cutoff edge 17 minimizes noise produced by the blower 10.

In operation, a flow of fluid is caused to flow into the compartment 12 of the housing 11 by the blades 18 of the impeller 16 via the fluid inlet 14. The axial flow of fluid is manipulated into the radially outward flow direction A by the blades 18 of the impeller 16. The blades 18 of the impeller 16 drive the flow of fluid radially outward to the fluid outlet 15. In the embodiment shown, the shroud 40 of the guide device 20 extends into the open area 28*c* of the fluid inlet 14, thereby covering the inlet end of at least a portion of the blades 18 of the impeller 16 and separating the flow of fluid through the fluid inlet 14 from the flow of fluid past the cutoff edge 17 and through the fluid outlet 15. The separation of the flow of fluid through the fluid inlet 14 minimizes a recirculation flow of the fluid at the fluid inlet 14. Accordingly, turbulence and noise produced by interference between the recirculation flow of the fluid and the flow of the fluid through the fluid inlet 14 is also minimized. Typically, in a floor mode, a heating mode and a defrost mode of a heating, ventilating, and air conditioning (HVAC) system, a flow resistance of duct passages of the HVAC system causes an accumulation of pressure and fluid within the compartment 12. However, the minimization of the recirculation flow of the fluid at the fluid inlet 14 facilitated by the shroud 40 also minimizes the accumulation of pressure and fluid within the compartment 12 caused by the flow resistance of the duct passages.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A centrifugal blower, comprising:

a hollow housing having a fluid inlet and a fluid outlet formed therein;

an impeller having a plurality of blades disposed in the hollow housing, wherein the impeller causes a fluid received in the fluid inlet to flow in a radially outward direction to the fluid outlet; and a guide device disposed in the fluid inlet, the guide device including a central hub, an outer ring, and a shroud having a leading edge, a trailing edge, and a free edge, wherein the shroud is configured to militate against a recirculation of flow of the fluid at the fluid inlet of the hollow housing, wherein the shroud is integrally formed with the outer ring and extends into an open area of the fluid inlet adjacent the fluid outlet, the shroud covering at least a portion of an inlet end of the blades of the impeller, and wherein the shroud includes a first radius and a second radius, the first radius formed in an intermediate portion of the shroud and the second radius formed in a portion of the shroud intermediate the first radius and the free edge and in a direction opposite the first radius.

2. The centrifugal blower according to claim 1, wherein the guide device includes a plurality of blades formed to extend between the central hub and the outer ring.

3. The centrifugal blower according to claim 2, wherein the shroud is integrally formed with the blades.

4. The centrifugal blower according to claim 2, wherein the shroud conforms to a curvature of the outer ring.

5. The centrifugal blower according to claim 2, wherein the shroud has a tapered width which gradually decreases from a portion adjacent the outer ring to the free edge thereof.

6. The centrifugal blower according to claim 1, wherein the trailing edge of the shroud and a cutoff position of the blower define a predetermined angle.

7. The centrifugal blower according to claim 1, wherein the shroud is slanted at a predetermined angle relative to a central axis of the guide device.

8. A centrifugal blower, comprising:

a hollow housing having a fluid inlet and a fluid outlet formed therein;

an impeller having a plurality of blades disposed in the hollow housing, wherein the impeller causes a fluid received in the fluid inlet to flow in a radially outward direction to the fluid outlet; and a guide device disposed in the fluid inlet, the guide device including a central hub, an outer ring, a plurality of blades formed to extend between the central hub and the outer ring, and a shroud formed between a pair of the blades, the shroud configured to militate against a recirculation of flow of the fluid at the fluid inlet of the hollow housing, wherein the shroud includes a leading edge, a trailing edge, and a free edge, wherein the shroud is integrally formed with the outer ring and extends into an open area of the fluid inlet adjacent to the fluid outlet, the shroud covering at least a portion of an inlet end of the blades of the impeller, and wherein the shroud includes a first radius and a second radius, the first radius formed in an intermediate portion of the shroud and the second radius formed in a portion of the shroud intermediate the first radius and the free edge and in a direction opposite the first radius.

9. The centrifugal blower according to claim 8, wherein the shroud is integrally formed with at least one of the blades.

10. The centrifugal blower according to claim 8, wherein the shroud conforms to a curvature of the outer ring.

11. The centrifugal blower according to claim 8, wherein the trailing edge of the shroud and a cutoff position of the blower define a predetermined angle.

12. The centrifugal blower according to claim 8, wherein the shroud has a tapered width which gradually decreases from a portion adjacent the outer ring to the free edge thereof.

13. The centrifugal blower according to claim 8, wherein the leading edge of the shroud is turned inward toward a central axis of the guide device at a predetermined angle from the direction of flow of the fluid.

14. The centrifugal blower according to claim 8, wherein the trailing edge of the shroud is turned inward toward a central axis of the guide device at a predetermined angle from the direction of flow of the fluid.

15. The centrifugal blower according to claim 8, wherein the leading edge of the shroud and a plane substantially parallel to a central axis of the guide device define a predetermined angle.

16. The centrifugal blower according to claim 8, wherein the trailing edge of the shroud and a plane substantially parallel to a central axis of the guide device define a predetermined angle.

17. The centrifugal blower according to claim 8, wherein the shroud is slanted at a predetermined angle relative to a central axis of the guide device.

18. The centrifugal blower according to claim 8, wherein at least one of the intermediate portion of the shroud and a portion of the shroud adjacent the free edge thereof includes a radius formed therein.

* * * * *